United States Patent [19]

Seener et al.

[11] Patent Number: 5,065,595

[45] Date of Patent: Nov. 19, 1991

[54] THERMOSTATIC EXPANSION VALVE

[75] Inventors: G. Thomas Seener, St. Louis; Joseph H. Heffner, Chesterfield, both of Mo.

[73] Assignee: Sporlan Valve Company, St. Louis, Mo.

[21] Appl. No.: 622,755

[22] Filed: Dec. 5, 1990

[51] Int. Cl.[5] ..... F25B 41/04

[52] U.S. Cl. ..... 62/212; 62/225; 236/92 B; 236/99 E

[58] Field of Search ..... 62/212, 210, 225; 236/92 B, 99 E

[56] References Cited

U.S. PATENT DOCUMENTS

| | | | |
|---|---|---|---|
| 990,772 | 4/1911 | Pollard | 62/212 |
| 2,511,565 | 6/1950 | Carter | 62/212 |
| 2,529,378 | 11/1950 | Dube et al. | 62/212 X |
| 3,785,554 | 1/1974 | Proctor | 62/212 X |

*Primary Examiner*—William E. Tapolcai
*Attorney, Agent, or Firm*—Cohn, Powell & Hind

[57] ABSTRACT

This thermostatic expansion valve (12) is intended for use in a refrigeration system (10) which includes a compressor (14), a condenser (16) and an evaporator (18). The valve (12) includes a valve body (20) having an inlet (26) and an outlet (28). A valve port (34) and a valve element (38) are disposed between the inlet and outlet. Upper and lower diaphragm assemblies (24, 25) are provided at each end of the valve (12) connected to associated sensing bulbs (56, 58) at the inlet and outlet respectively of the evaporator (18). A push rod assembly (40) operatively interconnects the upper and lower diaphragm assemblies (24, 25) and modulates the valve element (38) in response to the change in differential temperature across the evaporator. A compression spring (36) acts directly on the valve element and provides an adjustable feature.

6 Claims, 1 Drawing Sheet

THERMOSTATIC EXPANSION VALVE

BACKGROUND OF THE INVENTION

This invention relates generally to expansion valves for use in refrigeration/reclaim systems and particularly to a thermostatic expansion valve which can modulate valve flow independently of the system refrigerant.

In a conventional refrigeration or reclaim system of the type which includes a compressor, a condenser and an evaporator there is a need for a flow control device to meter liquid refrigerant into the evaporator at a precise rate. Various devices have been used to accomplish this flow control including fixed restrictor and variable restrictor devices. The former type of device, which utilizes capillary tubes and fixed orifices, provides precise metering but only under specific operating conditions. The latter types of device is more versatile and senses conditions within the refrigeration system to open or close the flow area to match the liquid refrigerant flow to existing conditions.

The most common form of variable restrictor device is the standard thermostatic expansion valve which senses the evaporator outlet temperature by means of a thermal bulb which is charged with a temperature sensitive gas or liquid refrigerant and creates a corresponding pressure acting on one side of the expansion valve motor element, usually a diaphragm. At the same time evaporator pressure is conducted from the evaporator through the valve and applied to the other side of the expansion valve motor element. In addition, it is customary to install a compression spring under the motor element which provides a force balance across the motor element and modulates the valve pin with respect to the valve port thereby controlling the refrigerant flow area. Valves of this type are manufactured by Sporlan Valve Company of St. Louis, Mo. and are disclosed in U.S. Pat. Nos. 2,573,151, 3,252,297, 3,742,722 and 4,750,334.

A primary problem with expansion devices of this type is that the sensing bulb charge must be selected to match the system refrigerant.

This thermostatic expansion valve solves this, and other problems, in a manner not disclosed in the known prior art.

SUMMARY OF THE INVENTION

This thermostatic expansion valve, for use in a refrigeration system which includes a compressor, a condensor and an evaporator, is adapted to modulate flow through the valve independently of refrigerant used in the refrigeration system.

It is an aspect of this invention to provide an expansion valve which includes a valve body having opposed ends, an inlet and an outlet, a valve port disposed between said inlet and said outlet, and said outlet communicating with the evaporator inlet; a valve element movable relative to the valve port to control flow through said port; a first motor means at one end of the valve body having opposed sides; first sensing means sensing the temperature of the evaporator outlet to apply a pressure to one side of the first motor means; a second motor means at the other end of the valve body having opposed sides; second sensing means sensing the temperature of the evaporator inlet to apply a pressure to one side of the second motor means; push rod means operatively engaging the first and second motor means and tending to open the valve port in response to pressure from the first motor means; spring means within the valve body operatively engageable with the valve element and cooperating with the pressure from the second motor means tending to close the valve port and means for communicating valve outlet pressure to the other side of each of said first and second motor means. This flow control is accomplished by utilizing upper and lower mechanically interconnected motor elements each having an associated temperature sensing bulb. The sensing bulb from the upper element is attached to the evaporator outlet as in a conventional expansion valve. the sensing bulb from the lower element is attached to the evaporator inlet. Thus, the expansion valve is responsive to temperature differential across the evaporator. An increase in this differential tends to open the valve and a decrease tends to close the valve.

It is another aspect of this invention to provide that the means for communicating valve outlet pressure includes passage means in the body communicating between the valve outlet and the other side of each of the first and second motor means to apply valve outlet pressure to said first and second motor means in opposition to the pressure applied to the first motor means by the first sensing means and to the pressure applied to the second motor means by the second sensing means.

It is another aspect of this invention to provide that the valve body includes an upper portion and a threadedly connected lower portion each of said portions having a passage providing said passage means.

It is another aspect of this invention to provide that the push rod means includes means operatively engageable with the valve element tending to open the valve port.

It is still another aspect of this invention to provide that the push rod means includes a central rod having an intermediate flange, said flange providing the means operatively engageable with the valve element.

It is yet another aspect of this invention to provide that the first and second motor means are provided by substantially identical diaphragm assemblies.

It is an aspect of this invention to provide that the expansion valve is relatively simple and inexpensive to manufacture and is highly efficient in operation.

DESCRIPTION OF THE PREFERRED EMBODIMENT

Figures 1, 2:
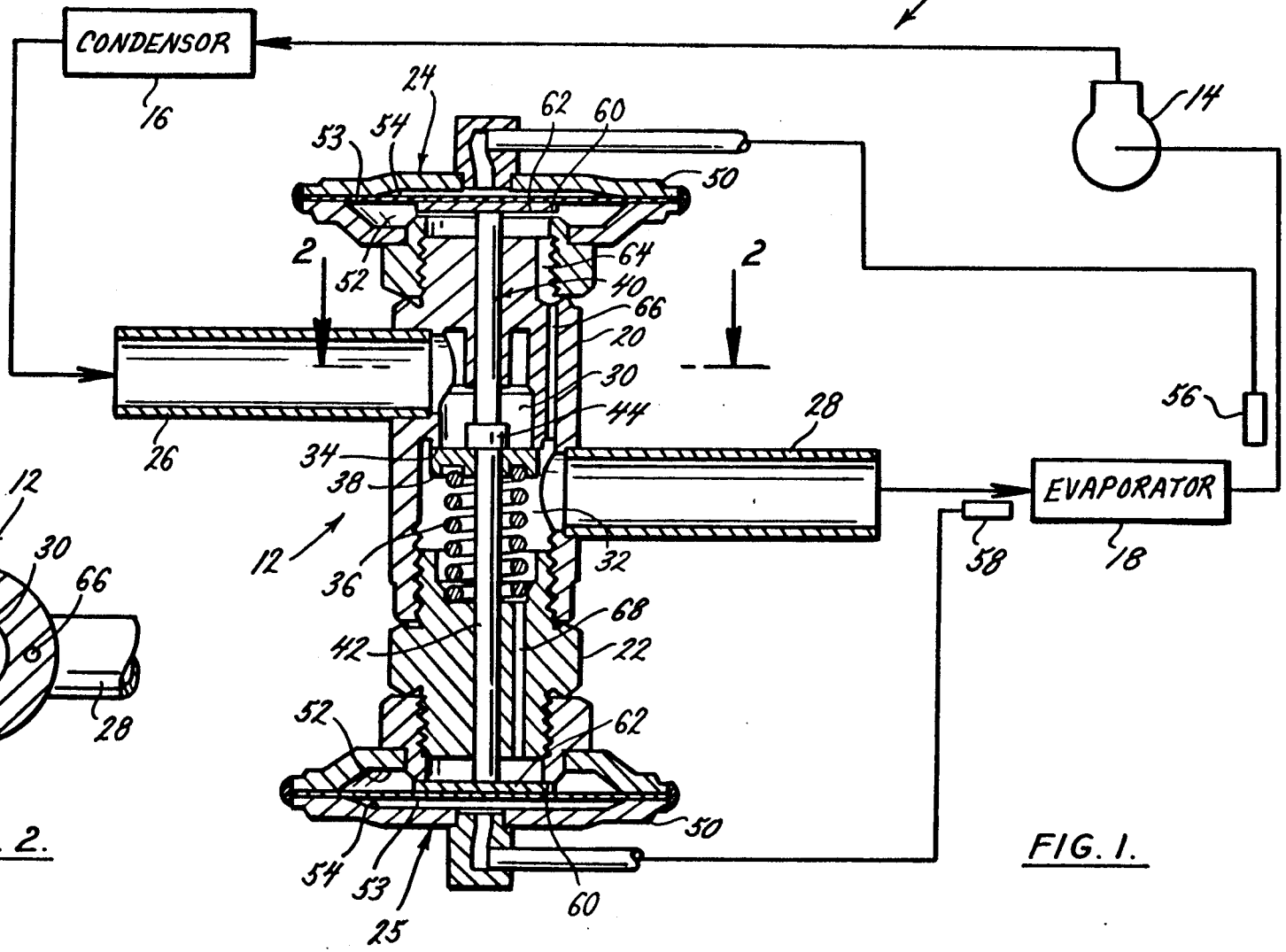
FIG. 1 is a longitudinal sectional view through the valve as used in a refrigeration system.
FIG. 2 is a cross sectional view taken on line 2—2 of FIG. 1.

Referring now by reference numerals to the drawing and first to FIG. 1, it will be understood that the thermostatic expansion valve 12 is used in an otherwise conventional refrigeration system generally indicated by numeral 10. As shown, the system incorporates a compressor 14, a condenser 16 and an evaporator 18 in addition to the improved expansion valve 12 which will now be described.

The valve 12 includes a body 20 having a threadedly connected bottom cap 22, providing a detachable lower portion for the body 20. Diaphragm assemblies 24 and 25 are provided at the upper and lower ends of the valve, which are threadedly connected to the upper end of the body 20 and the lower end of the bottom cap 22, respectively, and constitute first and second motor means. The valve body 20 also includes inlet and outlet fittings 26 and 28 communicating respectively with the outlet of the condenser 16 and the inlet of the evaporator 18.

The interior of the body 20 is arranged to provide an upper chamber 30 and lower chamber 32. The upper chamber 30 communicates with the inlet fitting 26 and at its lower end provides a valve seat 34 defining a valve port. The lower chamber 32 communicates with the outlet fitting 28 and provides a housing for an adjustable compression spring 36, which exerts a preselected upward pressure against a valve element in the form of a disc 38. Pressure from the spring 36 urges the valve disc 38 against the valve seat 34 tending to close the valve port.

A push rod assembly generally indicated by numeral 40 is mounted within passages provided in the body 20 and the end cap 22. The push rod assembly 40 includes a push rod 42 extending between the upper and lower diaphragm assemblies 24 and 25 and a fixed intermediate flange 44 engageable with the upper side of the valve disc 38, said disc being apertured to receive said rod 42.

The upper and lower diaphragm assemblies 24 and 25 are identical and each includes a housing 50 having inner and outer chambers 52 and 54 separated by a flexible diaphragm element 53. The outer chamber 54 of the upper diaphragm assembly 24 communicates with a first temperature-responsive sensor in the form of a bulb 56, which is attached to the outlet line of evaporator 18. The outer chamber 54 of the lower diaphragm assembly 25 communicates with a second temperature-responsive sensor in the form of a bulb 58 which is attached to the inlet line of evaporator 18. Each diaphragm assembly inner chamber 52 defines an annular seat 60 and the flexible diaphragm includes a disc 62 engageable with said seat.

In the embodiment shown, the upper portion of the valve body 20 includes passages 64 and 66 communicating between the diaphragm inner chamber 52 and the valve outlet fitting 28. The valve cap 22 likewise includes a passage 68 communicating between the lower diaphragm inner chamber 52 and the outlet fitting 28. Accordingly, the pressure on the inner side of each diaphragm 53 is equalized.

It is thought that the structural features of this expansion valve have been fully understood from the foregoing description of parts but for completeness of disclosure the operation of the valve 12 in the refrigeration system 10 will be briefly described.

The thermostatic expansion valve 12 modulates flow through the valve port 34 independently of the system refrigerant. This is effectuated by providing upper and lower diaphragm assemblies 24 and 25 each controlled by a temperature sensor in the form of thermal sensing bulbs 56 and 58 respectively which are attached to the outlet and inlet, respectively, of the evaporator 18. An increase in the sensed temperature at the outlet of the evaporator results in a pressure increase on the diaphragm 53 of the upper diaphragm assembly 24, which tends to move the push rod 42 downwardly, thereby tending to open the valve port. An increase in the sensed temperature at the inlet of the evaporator results in a pressure increase on the diaphragm 53 of the lower assembly 25, which tends to move the push rod 42 upwardly, thereby tending to open the valve port 34. The upper and lower diaphragm assemblies 24 and 25 are mechanically interconnected by the push rod 42 and accordingly, the valve element 38 is obliged to move into or out of the valve port in response to differential movement of the diaphragms 53.

System refrigerant pressure is prevented from affecting the force balance between the two assemblies 24 and 25 and the compression spring 36 by interconnecting the inner chambers 52 of the diaphragm assemblies 24 and 25. Such connection is provided by means of upper passages 64 and 66 and lower passage 68 which communicate with the outlet 28 and with each other. This arrangement allows the system pressure on each diaphragm 53 to be equalized.

The sensing bulb 56 from the upper assembly 24 is attached to the outlet of the evaporator 18 as in a conventional expansion valve. The sensing bulb 58 from the lower assembly 25 is attached to the inlet of the evaporator 18 and thus senses the temperature differential across said evaporator. An increase in this differential tends to open the valve 12 and a decrease in the differential tends to close said valve.

The force balance equations for a conventional thermostatic expansion valve and the present expansion valve may be compared using the following nomenclature:

Bulb temperature (converted to pressure)$=P_B$ ($P_{B1}$, $P_{B2}$)

Evaporator pressure$=P_E$

Diaphragm area$=A_M$ ($A_{M1}$, $A_{M2}$)

Valve port area$=A_P$

Condenser pressure$=P_C$

Spring force$=F$

For the conventional valve the equation is:

$$P_B A_M + A_P(P_C - P_E) = F + P_E A_M$$

For the improved valve the equation is:

$$P_{B1} A_{M1} + A_P(P_C - P_E) - F + P_{B2} A_{M2}$$

If the valve port $A_P$ is assumed negligible, or the force generated $A_P(P_C - P_E)$ is balanced away, the equations become:

$$\text{Conventional valve } P_B A_M = F + P_E A_M$$

$$\text{Present valve } P_{B1} A_{M1} = F + P_{B2} A_{M2}$$

Since there is no system pressure in the equation for the present valve, as there is in thermostatic expansion valves such as currently manufactured, for example, by Sporlan Valve Company as discussed herein, system refrigerant does not influence the valve modulation. Accordingly, modulation is affected only by temperature differential across the evaporator 18, causing the valve to restrict the flow area and precisely meter refrigerant to match system conditions.

It will be understood that the temperature responsive fluid employed in the motor elements 24 and 25 and associated sensing bulbs 56 and 58, respectively, must have a saturation pressure curve equal to or greater than the maximum saturation pressure curve of the system refrigerant to operate effectively as described.

Although the improved expansion valve has been described by making particularized reference to a preferred expansion valve mechanism, the details of description is not to be understood as restrictive, numerous variants, such as the use of a conical pin and port construction or multi-piece pushrod assembly construction, being possible within the principles disclosed and within the fair scope of the claims hereunto appended.

We claim as our invention:

1. In a refrigeration system of the type which includes a compressor, a condenser, and an evaporator, an expansion valve controlling flow of refrigerant into the evaporator, the expansion valve comprising:

(a) a valve body having opposed ends, an inlet and an outlet, a valve port disposed between said inlet and said outlet, and said outlet communicating with the evaporator inlet, (b) a valve element movable relative to the valve port to control flow through said port, (c) a first motor means at one end of the valve body having opposed sides, (d) first sensing means sensing the temperature of the evaporator outlet to apply a pressure to one side of the first motor means, (e) a second motor means at the other end of the valve body having opposed sides, (f) second sensing means sensing the temperature of the evaporator inlet to apply a pressure to one side of the second motor means, (g) push rod means operatively engaging the first and second motor means and tending to open the valve port in response to pressure from the first motor means, (h) spring means within the valve body operatively engageable with the valve element and cooperating with the pressure from the second motor means tending to close the valve port, and (i) means for communicating valve outlet pressure to the other side of each of said first and second motor means.

2. An expansion valve as defined in claim 1, in which:

(j) the means for communicating valve outlet pressure includes passage means in the body communicating between the valve outlet and the other side of each of the first and second motor means to apply valve outlet pressure to said first and second motor means in opposition to the pressure applied to the first motor means by the first sensing means and to the pressure applied to the second motor means by the second sensing means.

3. An expansion valve as defined in claim 2, in which:

(k) the valve body includes an upper portion and a threadedly connected lower portion, each of said portions having a passage providing said passage means.

4. An expansion valve as defined in claim 1, in which:

(j) the push rod means includes means operatively engageable with the valve element tending to open the valve port.

5. An expansion valve as defined in claim 4, in which:

(k) the push rod means includes a central rod having an intermediate flange, said flange providing the means operatively engageable with the valve element.

6. An expansion valve as defined in claim 1, in which:

(j) the first and second motor means are provided by substantially identical diaphragm assemblies.

* * * * *